United States Patent [19]

Layton et al.

[11] Patent Number: 4,461,347

[45] Date of Patent: Jul. 24, 1984

[54] HEAT EXCHANGE ASSEMBLY FOR ULTRA-PURE WATER

[75] Inventors: Howard M. Layton, New Fairfield; William Fenton, Danbury, both of Conn.

[73] Assignee: Interlab, Inc., Danbury, Conn.

[21] Appl. No.: 228,739

[22] Filed: Jan. 27, 1981

[51] Int. Cl.[3] ..... F28F 19/04; H05B 3/82; F24H 1/20

[52] U.S. Cl. ..... 165/133; 138/DIG. 3; 138/114; 165/154; 219/299; 219/306; 219/316; 219/523; 264/230; 285/55; 338/262; 338/268

[58] Field of Search ..... 219/299, 300, 306, 307, 219/316, 318, 335, 336, 528, 548, 549, 523; 338/214, 262, 268; 264/230; 165/163, DIG. 8, 133, 134, 154; 285/55; 138/DIG. 3, 114

[56] References Cited

U.S. PATENT DOCUMENTS

| | | | |
|---|---|---|---|
| 1,351,779 | 9/1920 | Mather | 219/306 X |
| 2,034,553 | 3/1936 | Askin | 165/154 |
| 2,727,979 | 12/1955 | Altosaar | 219/335 X |
| 2,833,909 | 5/1958 | Levey | 219/306 X |
| 2,879,372 | 3/1959 | Dammond | 219/299 X |
| 3,050,786 | 8/1962 | St. John et al. | 165/133 X |
| 3,097,288 | 7/1963 | Dunlap | 219/528 X |
| 3,191,971 | 6/1965 | Somers | 285/55 |
| 3,372,462 | 3/1968 | Reid et al. | 264/230 X |
| 3,388,562 | 6/1968 | Harle | 165/133 X |
| 3,470,046 | 9/1969 | Verdin | 264/230 X |
| 3,657,520 | 4/1972 | Ragault | 338/214 X |
| 3,663,799 | 5/1972 | McArn | 219/335 X |
| 3,870,033 | 3/1975 | Faylor et al. | 165/163 X |
| 4,032,748 | 6/1977 | Vischer et al. | 219/300 X |
| 4,116,016 | 9/1978 | Roop et al. | 165/133 X |
| 4,145,601 | 3/1979 | Lavrentiev et al. | 219/300 X |
| 4,158,764 | 6/1979 | Yane | 219/523 |
| 4,193,180 | 3/1980 | Press | 165/133 X |
| 4,296,804 | 10/1981 | Press et al. | 165/133 |

FOREIGN PATENT DOCUMENTS

| | | | |
|---|---|---|---|
| 1806722 | 5/1968 | Fed. Rep. of Germany | 219/307 |
| 2000894 | 7/1971 | Fed. Rep. of Germany | 219/307 |
| 1379701 | 10/1964 | France | 219/523 |
| 45-749 | 1/1970 | Japan | 165/133 |

*Primary Examiner*—A. Bartis
*Attorney, Agent, or Firm*—Michael Ebert

[57] ABSTRACT

A heat exchange assembly for raising a process fluid, such as ultra-pure, de-ionized water, to an elevated temperature without adversely affecting the quality thereof includes coaxially-arranged inner and outer pipes, the annular space therebetween defining a flow passage for the fluid to be heated. The inner pipe is formed of high-strength metal of good thermal conductivity and encloses a heat source, such as steam, circulating heated fluid or an electric heater. The inner pipe is ensheathed by an extruded heat-shrinkable plastic tube of non-reactive material, such as PTFE or polypropylene not exceeding 7 mils in thickness, which is shrunk-fit thereon to form one wall of the flow passage. The opposing wall of the passage is formed by the interior surface of the outer pipe which is also constituted by non-reactive plastic material such as PTFE or polypropylene. Terminations comprising all-plastic unions are provided at the ends of the inner and outer pipes to couple the passageway to inlet and outlet fitting for the process fluid. The outer pipe may be reinforced by a braided outer sleeve.

10 Claims, 4 Drawing Figures

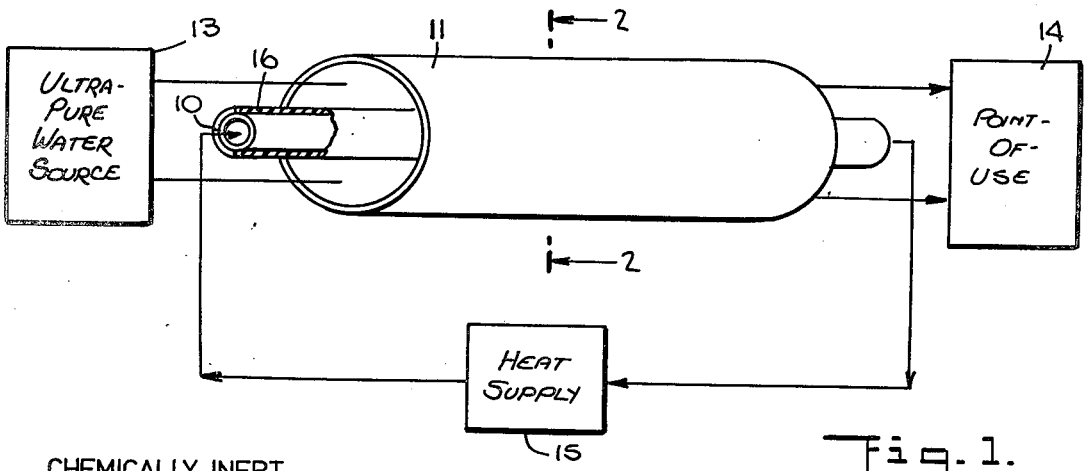
Fig. 1.
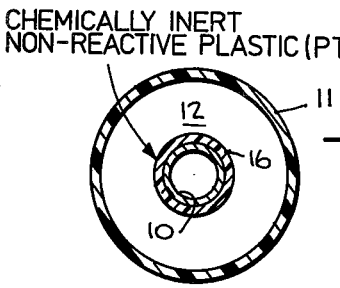
Fig. 2.
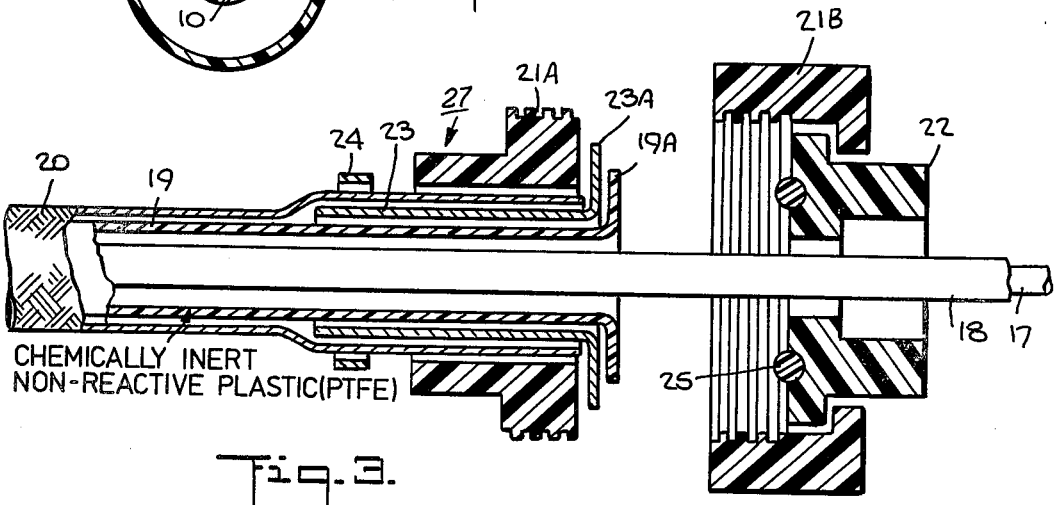
Fig. 3.
Fig. 4.
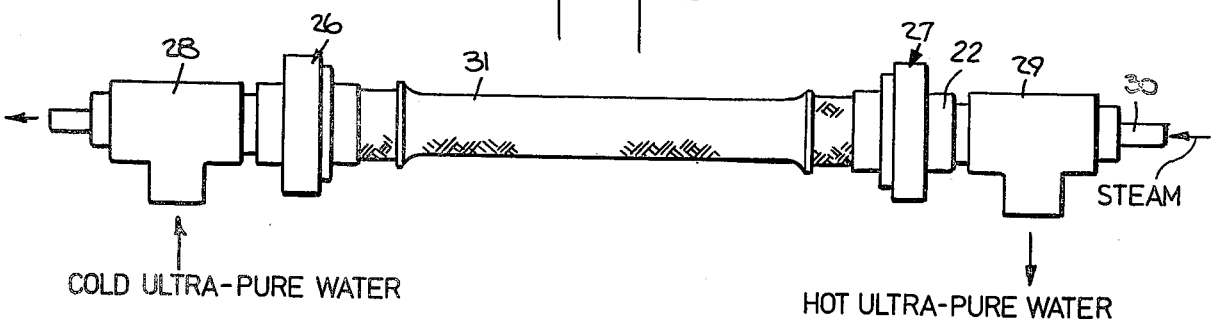

HEAT EXCHANGE ASSEMBLY FOR ULTRA-PURE WATER

BACKGROUND OF INVENTION

This invention relates generally to heat exchange assemblies for heating or cooling a process fluid, and more particularly to an assembly adapted to raise or lower the temperature of de-ionized process water without in any way affecting its ultra-pure condition.

The principal method used in making semiconductor devices for inclusion in monolithic or hybrid integrated circuits is planar technology whereby components such as transistors that are fabricated by the process extend below the surface of one plane of a silicon substrate or a substrate of glass or ceramic material. Fabrication of an integrated circuit involves various wet chemistry steps, many of which require critical cleaning operations in which the surfaces are rinsed with water. Because of the high sensitivity to contamination of wet chemistry processing in microelectronics, these rinsing phases must make use of water of extreme purity.

Though the concern of the present invention is primarily with heating ultra-pure de-ionized water while preserving its purity so that the heated water may be used to rinse the surfaces of microelectronic substrates, it is to be understood that a heat exchange assembly in accordance with the invention is by no means limited to this application and may be employed wherever the need exists in chemical and industrial processing for ultra-pure water at elevated or reduced temperatures. Also, the assembly, because it isolates the liquid being heated or cooled from the heating or cooling source by a chemically-inert layer, may be used in conjunction with corrosive liquids.

In the early years of microcircuit manufacturing, rinsing was performed with ultra-pure water at non-elevated temperatures, the temperature of the water being that prevailing at the point-of-use. The current practice, however, is to rinse with very hot demineralized water. Water cannot be purified to its ultimate state after being heated, the reason for this being that demineralizing resins are generally unsuitable for use at elevated temperatures. It is mandatory, therefore, that the heating apparatus perform its function at the final point-of-use, and that it assume full responsibility for maintaining the process water in its ultra-pure, demineralized condition.

In order to provide heated ultra-pure water at a point-of-use, it has heretofore been the practice to flow the water through a heat exchanger having smooth, crevice-free, internal metal structures. And since many metals conventionally used in heat exchangers, such as copper, tend to leach metallic ions from their surface which contaminate water, use is made in known types of heat exchangers for heating ultra-pure water of a non-leaching, non-corrosive metal such as passivated stainless steel. Other metals having minimal contaminating properties are block tin and tin-lined metals.

More recently, it has been found that certain plastics, especially those in the fluorocarbon family, are highly suitable for use in ultra-pure water heaters. Such inert plastics, when in contact with water, do not measurably degrade the quality of the water and are not subject to leaching of objectionable contaminants.

It has heretofore been proposed to provide in a heat-exchanger for heating ultra-pure water, tubes of polytetrafluoroethylene material (PTFE) for conducting steam or other hot fluid, the tubes being immersed in a bath of ultra-pure water in heat-exchange relationship therewith.

PTFE or "Teflon," as it is marketed by the duPont company, is highly resistant chemically within the limits of its thermal stability; for it is only affected by molten alkali metals and elemental fluorine at high pressures. Hence PTFE will not react with heated water, nor is it affected by temperatures up to 500° F., this being considerably higher than the temperature involved in heating ultra-pure water.

But because Teflon is a relatively poor heat conductor, should relatively thick-walled Teflon tubes be used in a heat exchange assembly, thermal transfer will be poor and difficulties will be experienced in effecting temperature control. On the other hand, a very thin Teflon tube, though providing much better heat transfer, is not only incapable of operating under pressure conditions, but its plastic walls often incorporate pores or pinholes. This gives rise to minute leakage paths resulting in contamination.

One possible solution to the problem of employing Teflon in a heat exchanger for ultra-pure water is to use metal structures coated with Teflon, so that while only the Teflon makes contact with the ultra-pure water, the underlying metal structure is capable of withstanding the operating pressures involved. Even though a very thin PTFE coating will not act as a significant thermal barrier and therefore not adversely affect the heat transfer characteristic of the unit, such thin coatings almost invariably suffer from some degree of porosity and will therefore permit ions to leach from the metal structure.

Moreover, with Teflon coating techniques, there is also an adhesion problem, so that it is usually necessary to first roughen or grit blast the substrate and then apply an appropriate primer thereto before applying the coating. Even then adhesion is not assured; for the wide difference in thermal expansion characteristics between metals and plastics may result in flaking of the coating and separation of the bond. This is particularly bothersome in the context of the significant temperature cycling operations inherent in many process applications.

SUMMARY OF INVENTION

In view of the foregoing, the main object of this invention is to provide an efficient, reliable and low cost heat exchange assembly for changing the temperature of ultra-pure water or other process fluid without adversely affecting the quality thereof.

A salient feature of the invention is that while the assembly makes use of metal pipes and other high-strength metallic structural elements, no contact is made between the process fluid being heated and any metallic surface that might in any way contaminate or react with the fluid.

More particularly, an object of this invention is to provide a heat exchange assembly in which a hot or cold source is enclosed in a metal pipe of high strength and good thermal conductivity, the pipe having a heat-shrinkable plastic tube shrunk-fit thereon to ensheathe the pipe with a protective layer that is impermeable to water in contact therewith, and is sufficiently thin to prevent the tube from acting as a thermal barrier and to therefore afford a thermal bridge between the source and the process liquid.

Also an object of the invention is to provide terminations for a heat exchange assembly in accordance with the invention, making it possible to interconnect the assembly with other fluid handling components or fittings, while at the same time preserving the desired pressure rating and avoiding metallic contact between plumbing devices and the process fluid.

Briefly stated, these objects are accomplished in a heat exchange assembly in accordance with the invention for raising ultra-pure water or other process fluid to an elevated temperature without adversely affecting the quality of the fluid. The assembly includes coaxially-arranged pipes, the annular space therebetween defining a flow passage for the process fluid.

The inner pipe is formed of high strength metal of good thermal conductivity having a thin heat-shrinkable tube of non-reactive synthetic plastic material such as TFE shrunk-fit thereon to create one wall of the passage. The interior surface of the outer tube is also constituted by non-reactive, synthetic plastic material to form the opposing wall of the passage. Enclosed in the inner pipe is a heating source which may take the form of a flowing hot fluid or fixed electrical heating elements, heat transfer to the liquid in the flow passage being through the thermally conductive metal wall of the inner pipe and the thin plastic covering thereon forming a thermal bridge. Or where the liquid in the flow passage is to be cooled, the source may be constituted by a coolant flowing through the inner pipe.

OUTLINE OF DRAWINGS

For a better understanding of the invention as well as other objects and further features thereof, reference is made to the following detailed description to be read in conjunction with the accompanying drawings, wherein:

FIG. 1 is a perspective view of a heat exchange assembly in accordance with the invention;

FIG. 2 is a transverse section taken in the plane indicated by line 2—2 in FIG. 1;

FIG. 3 illustrates, in section, a termination for a heat exchange assembly in accordance with the invention; and FIG. 4 is an assembly having terminations at both ends and coupled thereby to inlet and outlet fittings.

DESCRIPTION OF INVENTION

The Basic Assembly

Referring now to FIG. 1, a heat exchange assembly in accordance with the invention includes two coaxially-arranged pipes 10 and 11, the annular space between inner pipe 10 and outer pipe 11 defining a flow passage 12 for ultra-pure water or any other process fluid to be heated. The ultra-pure water is supplied by a source 13 which is coupled to the flow passage 12, the passage conducting the water heated therein to a point-of-use 14.

Inner or core pipe 10 encloses a heat source which in practice may be steam or hot liquid taken from a supply 15 and circulating continuously through the core pipe, or fixed electrical heating elements encased therein. Whether the heat source is a circulating liquid or a static electrical heater, the temperature of this source must be thermostatically or otherwise regulated so that the process fluid flowing at a given rate in annular passage 12 surrounding the heat source is raised in temperature to a desired level.

Inner pipe 10 is a metal such as copper or aluminum having adequate structural strength and good thermal conductivity. And because in a heater for ultra-pure water, contact between a metal pipe and the water cannot be tolerated, pipe 10 is ensheathed by a heat-shrinkable, non-reactive synthetic plastic tube 16 which is shrunk-fit on the pipe so that it is in intimate contact therewith. This plastic tube may be of PTFE, polypropylene or other heat-shrinkable synthetic plastic tubing which is chemically inert and non-reactive with the process liquid. The initial inside diameter of tube 16 is somewhat greater than the outer diameter of inner pipe 10; but when heat is applied thereto, tube 16 shrinks to an extent causing the tube to grip the wall of the pipe.

Commercially-available, heat-shrinkable tubing suitable for this purpose is Korvex TFE shrinkable tubing made of virgin Teflon by Chemplast, Inc. of Wayne, N.J. Heat-shrinkable tubing of this type is normally intended as insulating spaghetti for electrical conductors. Another commercially-available Teflon tubing is Zeiss Heat Shrink Tubing made by Zeiss Industrial Products of Raritan, N.J.

The advantage of using heat-shrinkable TFE tubing to ensheathe a metal pipe rather than coating the pipe with a PTFE film is that no problem of adhesion is experienced, and one can be sure of the absence of pinholes or pores by testing therefor before applying the tubing to the pipe. Preferably, the thickness of the PTFE tubing on the inner pipe is not in excess of 6 or 7 mils, so that the tubing does not create a significant thermal barrier and acts effectively as a thermal bridge. Commercially-available tubing, because it is extruded and not a sintered film as in a coating, is generally pore-free. However, even if minute pores exist in the shrinkable tube, the process of shrinking the tube normally brings about closure of whatever pores or pinholes exist, thereby protecting the ultra-pure water in contact with the tube from ions that would otherwise leach from the metal pipe.

In practice, particularly when the process fluid to be heated is a highly corrosive chemical, a second heat-shrinkable plastic tube may be shrunk-fit over the first tube to create a double-walled, pinhole-free interface between the metal pipe and the process fluid. Even this reinforced assembly typically results in better thermal transfer than is experienced with use of a conventional plastic tubing alone.

Because the flowing process fluid is thermally in contact, by way of the plastic tube, with the entire surface of the core pipe along the entire length thereof, the process fluid has optimum exposure to the thermal transfer surface area in relation to fluid volume flow rate. Otherwise stated, virtually all of the fluid volume is forced to pass through the heating assembly in close proximity to the heating surfaces.

Since outer pipe 11 does not function as a heat exchange member, it may be made entirely of non-reactive plastic material such as PTFE, in a wall thickness compatible with the application concerned. The plastic-ensheathed inner metal pipe makes possible more accurate temperature control with smaller excursions than an all-plastic inner pipe.

For operation at higher pressures that can be tolerated by an all-plastic outer pipe—that is, at pressures exceeding about 50 psi—use is preferably made of a composite outer pipe having an inner sleeve or liner formed of a chemically-inert material whose properties are similar or identical to those of the plastic shrunk-fit tubing on the inner pipe. The composite outer pipe further includes a braided, spirally-wound or other reinforcing metallic or non-metallic component as an outer sleeve. Thus the braiding may be metallic or formed of fiberglass. Fiberglass rubber-reinforced fluorocarbon tubing may be used for the outer pipe. In this way, one is able to accommodate a wide range of operating pressures while preserving the inert, non-metallic environment required for the process fluid being heated.

Termination

The coaxially-arranged inner and outer pipes from the heat exchange assembly require termination devices to permit interconnection with other fluid handling components and fittings in a manner preserving the desired pressure ratings, yet avoiding any metal contact between plumbing devices and the heated process fluid. When only modest operating temperature excursions are involved, a plastic-coated metal fitting may be used.

However, for applications in which the ultra-pure water or other process fluid is subject to relatively wide temperature excursions, say, between ambient and 70 degrees centigrade, a heat exchange assembly in accordance with the invention, when used with conventional terminations and fittings, may be susceptible to fluid leakage because of the differences in thermal expansion and contraction rates of interfacing metal and plastic fittings and surfaces.

In order, therefore, to provide a termination capable of operating over relatively wide excursions in temperatures without leakage problems, a termination as shown in FIG. 3 is provided for an assembly including an inner metal pipe 17 having a protective shrunk-fit plastic tube 18 thereon through which flows a heated fluid such as steam serving as the heat source. The outer pipe is a composite formed by an all-plastic inner sleeve 19 and a reinforcing braided outer sleeve 20. The ultra-pure water to be heated flows through the annular passage whose opposing walls are plastic tube 18 on the inner pipe and plastic inner sleeve 19 of the outer pipe.

The termination is constituted by an all-plastic union having an externally-threaded male member 21A which surrounds the end of the outer pipe, an internally-threaded female member 21B and a bushing 22 which is telescoped within the female member, the inner pipe 17 passing coaxially through the bushing.

A flanged metal insert or ferrule 23 is provided whose tubular shank is interposed between the braided outer sleeve 20 of the outer pipe and the plastic inner sleeve 19 thereof, the flange 23A of the ferrule lying against the outer face of the male component of the union. A clamp 24 encircling outer sleeve 20 acts to retain the ferrule between the inner and outer sleeves of the outer pipe. The plastic inner sleeve 19 at the end of the outer pipe is flared to create a flange 19A which overlies flange 23A of the ferrule.

When the male component of the union is joined to the female component thereof, inner sleeve flange 19A is pressed against the complementary face of bushing 22, this face being provided with an O-ring 25 to afford a fluid seal. Thus the ultra-pure water heated in the assembly passes through the central bore in the plastic bushing of the union and makes no contact at any point with any metallic element. In practice, the tubular ferrule, instead of being interposed between the inner and outer sleeves of the outer pipe, may surround the outer sleeve, the flared end of the plastic inner sleeve lying against the flange of the ferrule, so that it is compressed when the components of the union are joined together.

FIG. 4 illustrates a complete coaxial heat exchange assembly in accordance with the invention terminated at either end by terminations 26 and 27. These terminations, which are essentially of the type shown in FIG. 3, couple the coaxial heat exchange assembly to plastic Tees 28 and 29, respectively, which provide an inlet and outlet, respectively, for the ultra-pure water to be heated.

In FIG. 4, the inner pipe 30, which is coaxially disposed within outer pipe 31, is ensheathed in a shrunk-fit plastic tube, the steam or other hot fluid which provides the thermal energy for heating the ultra-pure water entering inner pipe 30 at the right end and being discharged from the left end.

Though the flaring of plastic tube terminations is conventional when flanged couplings are employed, the integration of a flared plastic end with a threaded plastic union in the manner of the present invention is unique and has the advantage of physical compactness and ease of installation when compared with conventional bolted flange arrangements.

While there has been shown and described a preferred embodiment of a heat exchange assembly for ultra-pure water in accordance with the invention, it will be appreciated that many changes and modifications may be made therein without, however, departing from the essential spirit thereof. Thus instead of a process fluid passageway defined between inner and outer pipes, the inner pipe may be surrounded by a chamber having a plastic lined wall through which the process fluid flows. Or the inner pipe ensheathed in a plastic tube may be coiled and disposed within a large outer pipe to increase the heat transfer surface between the heat source within the inner pipe and the process liquid flowing through the outer pipe.

We claim:

1. A heat exchange assembly for heating or cooling a process liquid, such as ultra-pure water, without adversely affecting the quality thereof, said unit comprising:

A. an inner pipe formed of high-strength metal having good thermal conductivity, said inner pipe containing a heat exchange agent whose temperature differs from that of said process liquid;

B. a thin-walled tube extruded of a heat-shrinkable synthetic plastic material non-reactive with said liquid, said tube having an inner diameter which is initially slightly larger than the outer diameter of the pipe and being shrunk-fit on said inner pipe to define a pore-free outer layer having a degree of thinness in a range whose upper limit is about 7 mils affording a thermal bridge;

C. a flow passageway surrounding said inner pipe for said process liquid to effect heat transfer between said agent and said liquid by conduction through the metal of said inner pipe and said thermal bridge, one wall of said passageway being defined by said non-reactive outer layer, the opposing wall of said passageway being defined by a outer pipe of synthetic plastic material in contact with said liquid and non-reactive therewith, said outer pipe being coaxial with said inner pipe; and D. terminations at either end of said coaxially-arranged inner and outer pipes to couple said passageway to inlet and outlet fittings for said process liquid, said terminations each comprising a plastic union having male and female components and a bushing telescoped within the female component, an end of the inner pipe passing through the bushing, the end of the outer pipe being flared to define a flange that is compressed between a face of the male component and a complimentary face of the bushing, the male component being secured to the end of the outer pipe, the female component being detachably secured to the male component to maintain the flange of the outer pipe compressed between the bushing and the face of the male component.

2. An assembly as set forth in claim 1, wherein said tube and said outer pipe are fabricated of polytetrafluoroethylene.

3. An assembly as set forth in claim 1, wherein said tube and said outer pipe are fabricated of polypropylene.

4. An assembly as set forth in claim 1, wherein said outer pipe is relatively thick and is formed by an inner sleeve of synthetic plastic, non-reactive material and an outer reinforcing sleeve.

5. An assembly as set forth in claim 4, wherein said outer sleeve is of braided construction.

6. An assembly as set forth in claim 1, wherein said process liquid is ultra-pure water.

7. An assembly as set forth in claim 1, wherein said process liquid is a corrosive chemical.

8. An assembly as set forth in claim 1, wherein said outer pipe is comprises a plastic inner sleeve and a reinforcing outer sleeve.

9. An assembly as set forth in claim 8, further including a tubular ferrule inserted between the inner and outer sleeves of the outer pipe and having a flange interposed between the inner sleeve flange and the face of the male component.

10. An assembly as set forth in claim 9, further including an O-ring on the face of the bushing to engage the inner sleeve flange to effect a liquid seal therewith.

* * * * *